US007141536B2

(12) United States Patent
Ohkawa et al.

(10) Patent No.: US 7,141,536 B2
(45) Date of Patent: Nov. 28, 2006

(54) LUBRICANT

(75) Inventors: Koue Ohkawa, Inuyama (JP); Katuyosi Mizojiri, Inuyama (JP); Nobukatu Kimura, Inuyama (JP); Takayuki Shibayama, Inuyama (JP)

(73) Assignee: Daido Metal Company, Ltd., Nagoya (JP)

( * ) Notice: Subject to any disclaimer, the term of this patent is extended or adjusted under 35 U.S.C. 154(b) by 427 days.

(21) Appl. No.: 10/678,265

(22) Filed: Oct. 6, 2003

(65) Prior Publication Data

US 2004/0067858 A1 Apr. 8, 2004

(30) Foreign Application Priority Data

Oct. 4, 2002 (JP) ..... 2002-292380

(51) Int. Cl.
*C10M 173/02* (2006.01)
*C10M 173/00* (2006.01)

(52) U.S. Cl. ..... 508/220

(58) Field of Classification Search ..... None
See application file for complete search history.

(56) References Cited

U.S. PATENT DOCUMENTS 3,632,354 A * 1/1972 Swaine et al. ..... 426/590
3,832,475 A * 8/1974 Zirlin ..... 426/590

FOREIGN PATENT DOCUMENTS

JP 2001-172664 6/2001

OTHER PUBLICATIONS

JPO abstract of JP 2003-277786A, Okawa et al. (Oct. 2, 2003).*
"Caramelization," © 2003 The Gale Group Inc., obtained at http://food.families.com/caramelization-316-317-efc.*
"Caramelization," obtained at http://food.oregonstate.edu/glossary/c/d81.html.*
"Caramel," obtained at http://food.oregonstate.edu/glossary/c/caramel.htm.*
"Caramel," obtained at http://food.oregonstate.edu/glossary/c/cdef/cdef45.htm.*
Obtained translation of JP 2001172664 A (Jun. 26, 2001) Sugita, et al.*

* cited by examiner

*Primary Examiner*—Matthew A. Thexton
(74) *Attorney, Agent, or Firm*—Browdy and Neimark, PLLC

(57) ABSTRACT

A lubricant which is non-polluting and substitutable for conventional lubricants and which is excellent in lubrication characteristics, particularly having low frictional characteristics comprises an aqueous solution containing a saccharide in an amount of 0.5–30% by mass based on the total amount of the aqueous solution the saccharide comprising mainly a sucrose and a disaccharide caramel in an amount of 0.2–20% by mass based on the amount of the sucrose. As the sucrose, granulated sugar or crystal sugar is preferred, and coffee sugar containing previously a disaccharide caramel can also be used. More preferably, the lubricant contains sodium laurate and/or potassium laurate in an amount of 0.001–1% by mass. Furthermore, it is desired that the lubricant contains potassium sorbate in an amount of 0.1–3% by mass as a preservative and benzotriazole or an alkali metal salt thereof in an amount of 0.1–3% by mass as a rust inhibitor.

4 Claims, 2 Drawing Sheets

LUBRICANT

BACKGROUND OF THE INVENTION

The present invention relates to a lubricant used for lubrication between solid frictional surfaces.

Petroleum liquid lubricants are generally used for lubrication of, for example, bearings, gears, pistons, and cylinders in various machines such as engines, electric motors and generators. However, if these petroleum lubricants are imprudently leaked or abandoned, they sometimes cause pollution of natural environment. On the other hand, as liquid lubricants which do not Cause pollution of natural environment and are substitutable for the conventional petroleum lubricants, there are proposed lubricants comprising an aqueous solution containing not less than 0.1% by mass of a saccharide such as purified sugar, crude sugar, molasses-containing sugar or the like (e.g., JP-A-2001-172664).

However, in the case of the above so-called aqueous lubricants containing saccharides, all of the saccharides not necessarily provide good lubrication characteristics (low frictional characteristics, high wear resistance, anti-seizure characteristics), and some of the saccharides are inferior particularly in anti-seizure characteristics. As a result of the subsequent research conducted by the inventors, it has been found that sucrose is a saccharide to be used for non-pollution lubricants and can give excellent lubrication characteristics, particularly, anti-seizure characteristics, and the inventors developed aqueous lubricants using sucrose as the saccharide and filed a patent application (Japanese Patent Application No. 2002-86260).

Thus, the invention of aqueous lubricants which use sucrose as a saccharide could produce excellent results in improvement of lubrication characteristics of aqueous lubricants. However, the inventors have conducted further research in an attempt to attain further improvement of lubrication characteristics, particularly, further reduction of friction coefficient.

Therefore, the object of the present invention is to provide lubricants which cause no environmental pollution and are substitutable for conventional lubricants and which are excellent in lubrication characteristics, particularly, low frictional characteristics.

SUMMARY OF THE INVENTION

The inventors have already known that good lubrication characteristics, particularly, excellent anti-seizure characteristics can be obtained by using a sucrose which is a disaccharide of trehalose type in non-pollution aqueous lubricants comprising aqueous solutions containing saccharides. Among saccharides, those which have a cyclic hydrocarbon structure generally show good sliding characteristics in water, and, particularly, saccharides in which carbon atoms having alcohol groups are bonded through an ether linkage, such as sucrose, can give excellent lubrication characteristics. It is supposed that this is because in using as aqueous lubricants the alcohol group attaching to carbons in the form of ether linkage imparts affinity with metal surface, and, hence, sucrose adsorbs to the metal surface which is a sliding surface to develop excellent sliding characteristics (anti-seizure characteristics).

The inventors have further conducted tests and researches in an attempt to further improve lubrication characteristics, particularly, low frictional characteristics of aqueous lubricants containing mainly sucrose as a saccharide, and, as a result, have found that the friction coefficient is considerably reduced by adding a suitable amount of a disaccharide caramel to sucrose which is a main component, and accomplished the present invention.

That is, the lubricant of the present invention comprises an aqueous solution containing a saccharide in an amount of 0.5–30% by mass based on the total amount of the aqueous solution, said saccharide comprising a sucrose and a disaccharide caramel in an amount of 0.2–20% by mass based on the amount of the sucrose. Thus, there can be provided a lubricant which causes no pollution of natural environment, is substitutable for conventional lubricants and is excellent in lubrication characteristics, especially, in low frictional characteristics.

Here, the disaccharide caramel is a millet jelly-like amorphous material produced by melting a disaccharide (e.g., sucrose) with heating at about 200° C. The inventors have elucidated that the friction coefficient can be sharply reduced by adding the disaccharide caramel to sucrose as compared with using sucrose alone. It has been further elucidated that the effect of reducing the friction coefficient cannot be obtained with use of caramels prepared from monosaccharides.

The amount of the disaccharide caramel added is desirably 0.2–20% by mass based on the amount of sucrose. Moreover, the content (concentration) of saccharide (sum of the contents of sucrose and disaccharide caramel) is desirably 0.5–30% by mass based on the total amount of the aqueous solution. If the content of the saccharide is less than 0.5% by mass, abrasive wear and friction coefficient increase and, besides, the anti-seizure properties are inferior, and if it exceeds 30% by mass, abrasive wear and friction coefficient increase.

As methods for adding the disaccharide caramel to sucrose, there may be employed a method which comprises previously melting sucrose by heating, adding the disaccharide caramel thereto and uniformly dispersing them, then solidifying the dispersion by cooling or crystallizing the dispersion by slow cooling, grinding the resulting product, and dissolving the product in water. Alternatively, simply sucrose and disaccharide caramel may be separately added and be dissolved in water.

Furthermore, the sucrose is generally a main component of sugar, and includes white superior soft sugar, yellow soft sugar and granulated sugar, etc. depending on the degree of purification, the method of production and the starting materials. Preferably, granulated sugar or crystal sugar of high purity is used as sucrose. Thus, the effect to reduce the friction coefficient can be further enhanced.

An alkali metal salt of lauric acid, namely, sodium laurate and/or potassium laurate may be added in an amount of 0.001–1% by mass to the above aqueous solution. By adding the alkali metal salt, anti-seizure properties can be further enhanced.

It is considered that this is because molecules of the alkali metal salt of an fatty acid used as a surface active agent are orientated by chemical adsorption or physical adsorption to the sliding metal surface to improve the anti-seizure properties due to the synergistic effect with sucrose, and especially alkali metal salts of lauric acid are low and stable in specific surface tension in the service temperature area as compared with alkali metal salts of other fatty acids such as stearic acid, and, as a result, the surface of sliding materials is readily wetted with the aqueous solution.

Even a very small amount of the alkali metal salt of lauric acid can provide the effects, and the content is desirably 0.001–1% by mass based on the total amount of the aqueous solution. If the content of the alkali metal salt of lauric acid is less than 0.001% by mass, the effect to improve the anti-seizure properties cannot be obtained, and if it exceeds 1% by mass, both the abrasive wear and friction coefficient increase.

Potassium sorbate as a preservative may be added in an amount of 0.1–3% by mass to the above aqueous solution. By adding the preservative, occurrence of hygienic problems caused by generation and proliferation of bacteria or fungi and problems in lubrication performance can be prevented, and lubricants which can stand long use can be obtained.

As a result of the tests conducted on a plurality of preservatives by the inventors to confirm the preservation effects, it has been elucidated that use of potassium sorbate is most preferred because it is excellent in the effect as a preservative and it gives substantially no adverse effects on environments. The suitable amount of potassium sorbate is 0.1–3% by mass based on the total amount of the aqueous solution. If the amount is less than 0.1% by mass, the effect as a preservative cannot be sufficiently obtained, and even if it is added in an amount exceeding 3% by mass, the effect no longer increases.

Benzotriazole or an alkali metal salt thereof as a rust inhibitor may be added in an amount of 0.1–3% by mass to the above aqueous solution. By adding the rust inhibitor, generation of rust on a counter member (a sliding surface) can be prevented, and lubricants which can stand long use can be obtained.

As a result of tests conducted also on a plurality of rust inhibitors by the inventors to confirm the rust inhibiting effects, it has been elucidated that use of benzotriazole or an alkali metal salt thereof is most preferred. The suitable amount of the rust inhibitor is 0.1–3% by mass based on the total amount of the aqueous solution. If the amount is less than 0.1% by mass, the effect as a rust inhibitor cannot be sufficiently obtained, and even if it is added in an amount exceeding 3% by mass, the effect no longer increases.

Figure 1:
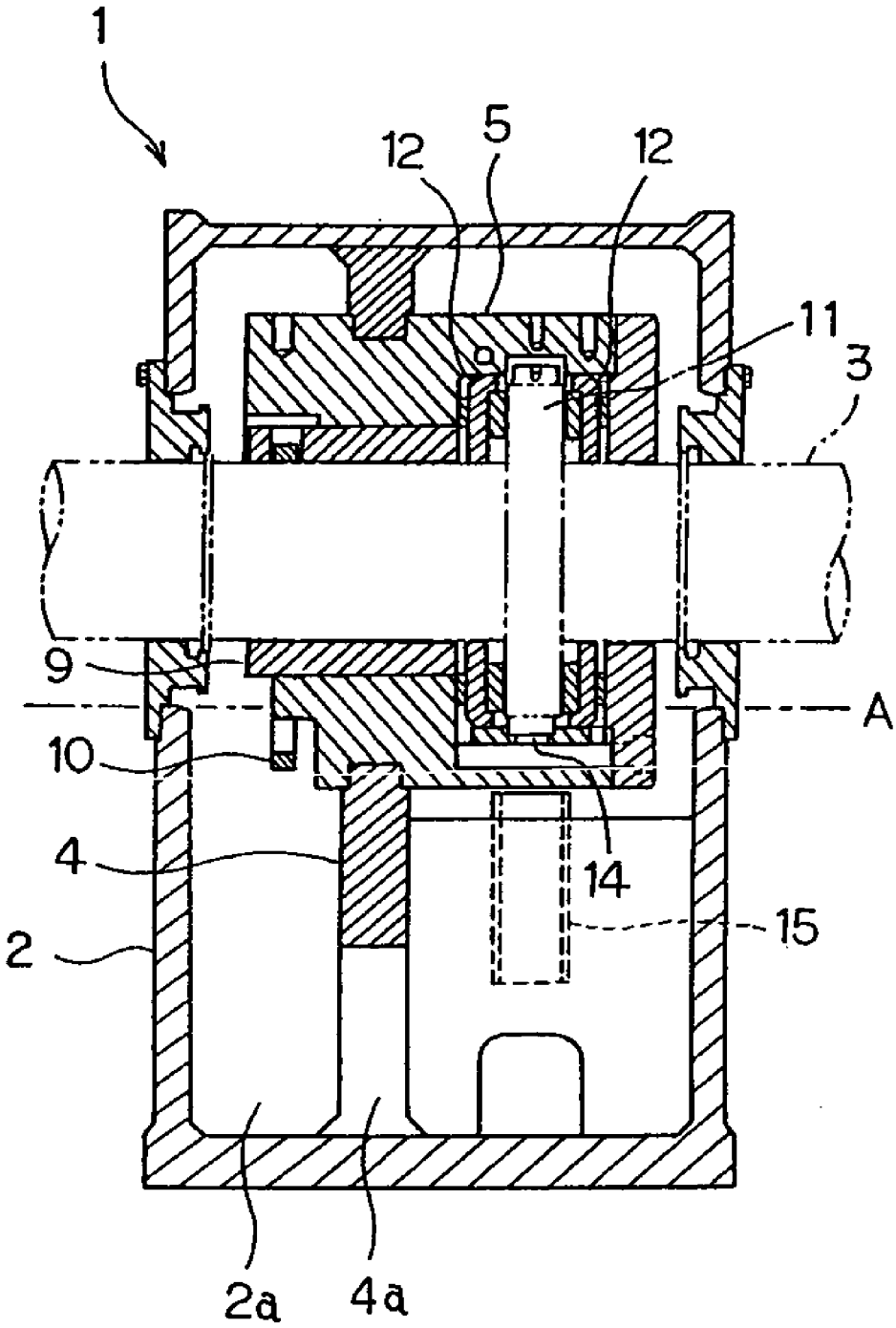
FIG. 1 is a longitudinal sectional front view of a bearing unit which shows an embodiment according to the present invention.

In the above drawings, the reference numerals indicate the following portions.

1: bearing unit; 2: casing; 2*a*: lubricant reservoir; 3: rotor shaft; 6: lubricant tank; 7: supplying pipe; 8: returning pipe; 9: journal bearing; and 12: thrust bearing.

DETAILED DESCRIPTION OF THE INVENTION

The embodiments of the present invention will be explained below referring to the drawings. First, a lubrication structure in a bearing unit which supports a rotor shaft of a hydroelectric power generator will be simply explained referring to FIG. 1 and FIG. 2 as a specific example where the lubricant of an embodiment of the present invention is used.

The bearing unit 1 is provided with a box casing 2, and a rotor shaft 3 is supported in such a state as horizontally passing through the casing 2 at a central, but somewhat upper position thereof in FIG. 1. In this case, the portion through which the rotor shaft 3 passes in the casing 2 is in a sealed state with an oil seal or the like. In the casing 2, a supporting wall portion 4 is provided so as to partition the casing 2 into a right part and a left part in FIG. 1, and a bearing housing 5 is set on the supporting wall portion 4. The lower part in the casing 2 constitutes a lubricant reservoir 2*a* containing the lubricant of this embodiment. The details of this lubricant will be mentioned later.

Figure 2:
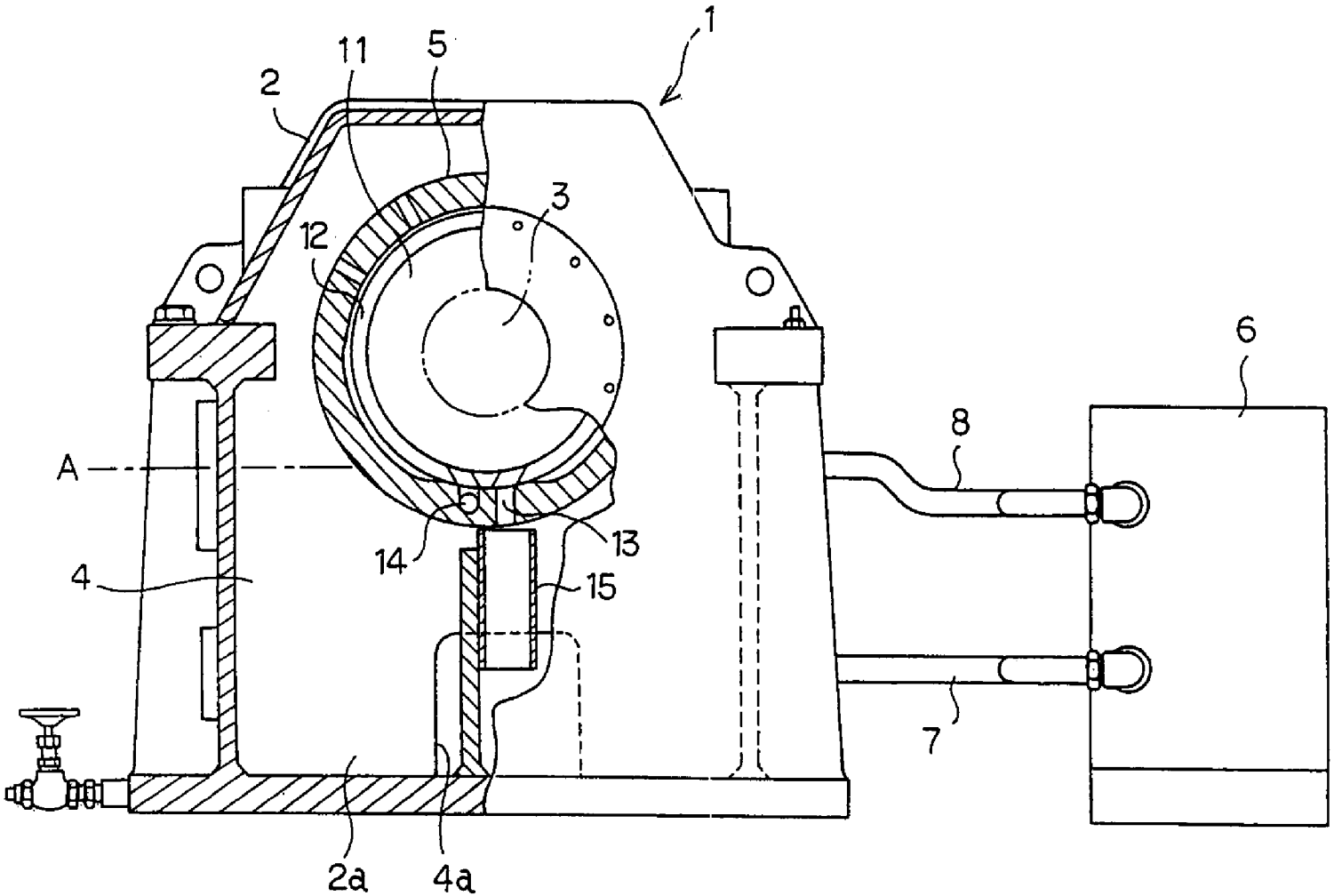
FIG. 2 is a side view of a bearing unit which is shown partly cut away and in section according to an embodiment of the present invention.

A lubricant tank 6 is provided outside the casing 2 as shown in FIG. 2, and is connected to the lower part of the casing 2 by a supplying pipe 7 and a returning pipe 8. A lubricant is contained in the lubricant tank 6, which has a cooling function to cool the lubricant. Thus, the following circulation is carried out, namely, the lubricant of low temperature is supplied from the lubricant tank 6 to the lubricant reservoir 2*a* in the casing 2 through the supplying pipe 7, and simultaneously the lubricant of high temperature in the casing 2 is returned to the lubricant tank 6 through the returning pipe 8 and cooled therein. In the casing 2, the level A of the lubricant is always kept. Furthermore, an opening 4*a* is provided at the supporting wall portion 4 so as to be able to flow the lubricant.

As shown in FIG. 1, a cylindrical journal bearing 9 for supporting radial load of the rotor shaft 3 is provided in the left half part of the inner peripheral part of the bearing housing 5. A nearly upper half portion of this journal bearing 9 is cut off in a part of axial direction (the left end portion in FIG. 1), and a ring 10 for supplying the lubricant is provided at the cut-off position. The upper inner periphery of this ring 10 is caught by the rotor shaft 3 and the lower part is immersed in the lubricant, and the lubricant is taken up by the ring 10 with revolution of the rotor shaft 3 and circulated and supplied to the frictional sliding surface between the journal bearing 9 and the rotor shaft 3.

In the middle of the rotor shaft 3, there is provided a collar portion 11 having a larger diameter, and a portion of a larger diameter corresponding to the collar portion 11 is provided in the right half part of the inner peripheral portion of the bearing housing 5, and a pair of thrust bearings (tilting pad bearings) 12, 12 for supporting the thrust load of the rotor shaft 3 is provided with holding the collar portion 11 therebetween. As known well, the thrust bearing 12 is constructed with having a plurality of thrust pads on the inner surface of carrier ring, and a spacer is provided between the bearing housing 5 and the outer surface of the carrier ring.

In this case, a lubricant inlet 13 and a lubricant outlet 14 are formed at the positions of the outer peripheral side of the collar portion 11 in the lower part of the bearing housing 5, and, furthermore, in the casing 2, a suction pipe 15 is provided to be connected with the lubricant inlet 13. Thus, the lubricant is sucked up from the lubricant inlet 13 through the suction pipe 15 by pumping action generated by the revolution of the collar portion 11 which revolves together with the rotor shaft 3, and the lubricant is circulated and supplied to the frictional sliding surface through the outer peripheral part of the collar portion 11, and, furthermore, the lubricant is also supplied through the lubricant outlet 14 to the adjacent journal bearing 9.

Here, the lubricant of this embodiment will be explained. This lubricant comprises an aqueous solution which contains 0.5–30% by mass (based on the total amount of the aqueous solution) of a saccharide comprising a sucrose and a disaccharide caramel in an amount of 0.2–20% by mass based on the sucrose, an alkali metal salt of lauric acid, potassium sorbate as a preservative, benzotriazole as a rust inhibitor, and the remainder of water (pure water).

As the alkali metal salt of lauric acid, sodium laurate can be used and the amount thereof is 0.001–1% by mass. Moreover, the amount of the potassium sorbate added is 0.1–3% by mass, and the amount of the benzotriazole added is 0.1–3% by mass. As the alkali metal salt of lauric acid, there may be used potassium laurate or a mixture of sodium laurate and potassium laurate, and as the preservative, there may be used an alkali metal salt of benzotriazole.

Table 1 given hereinafter shows results of frictional wear tests conducted to demonstrate that lubricants comprising aqueous solutions containing a suitable amount of a sucrose and a disaccharide caramel as a saccharide (Examples 1–10) have excellent sliding characteristics (low frictional characteristics, wear resistance, anti-seizure characteristics) as compared with those of comparative examples (Comparative Examples 1–7).

That is, Examples 1–10 relate to the lubricants of the present invention. In Examples 1–9, granulated sugar, crystal sugar and cane sugar were used as sucrose. The cane sugar was 99.5% in sucrose purity and in the form of particles, and the granulated sugar was one prepared by further purifying the cane sugar to a sucrose purity of 99.95%. The crystal sugar was one which was prepared by melting the granulated sugar, slowly cooling the molten sugar to grow large crystals, and grinding the crystal sugar (99.95% in sucrose purity). The disaccharide caramel used had a brown amorphous crystal structure in the form of millet jelly prepared by boiling down cane sugar of 99.5% in sucrose purity at about 200° C.

In Example 10, coffee sugar was used. This coffee sugar was prepared by melting granulated sugar, adding thereto 1% by mass of disaccharide caramel, adding a seed crystal, followed by slow cooling for several days to grow large crystals, removing impurities, and then grinding the crystals.

Specifically, the lubricant of Example 1 comprised an aqueous solution comprising 0.5% by mass of granulated sugar, 0.015% by mass of the disaccharide caramel (about 2.9% by mass based on the total amount of the saccharide) and the remainder of water (pure water); the lubricant of Example 2 comprised an aqueous solution comprising 25% by mass of granulated sugar, 5% by mass of the disaccharide caramel (about 16.7% by mass based on the total amount of the saccharide) and the remainder of water (pure water); and the lubricant of Example 3 comprised an aqueous solution comprising 9% by mass of granulated sugar, 1% by mass of the disaccharide caramel (about 10% by mass based on the total amount of the saccharide) and the remainder of water (pure water).

The lubricants of Examples 4, 5 and 6 comprised aqueous solutions comprising 9% by mass of granulated sugar and 1% by mass of the disaccharide caramel as in Example 3 and additionally 0.002% by mass, 0.9% by mass and 0.2% by mass of sodium laurate, respectively, and the remainder of water. The lubricant of Example 7 comprised an aqueous solution comprising the same components as in Example 6, and additionally 1% by mass of potassium sorbate as a preservative and 1% by mass of benzotriazole as a rust inhibitor, and the remainder of water.

The lubricant of Example 8 comprised an aqueous solution comprising 9% by mass of crystal sugar and 1% by mass of the disaccharide caramel (10% by mass based on the total amount of the saccharide), and additionally 0.2% by mass of sodium laurate, 0.5% by mass of potassium sorbate and 0.5% by mass of benzotriazole, and the remainder of water. The lubricant of Example 9 was the same as of Example 3, except that 9% by mass of cane sugar was used in place of the granulated sugar, and the lubricant of Example 10 comprised an aqueous solution comprising 10% by mass of coffee sugar (prepared by adding disaccharide caramel to granulated sugar, followed by crystallization) and the remainder of water.

The amount of the saccharide added was 0.515% by mass in Example 1, 30% by mass in Example 2, and 10% by mass in all of Examples 3–10. These Examples carried out the tests with omitting (not adding) the preservative (potassium sorbate) and the rust inhibitor (benzotriazole in order to conduct pure examination on the effects (sliding characteristics) of aqueous solutions containing sucrose and disaccharide caramel, except for Examples 7 and 8.

On the other hand, Comparative Examples 1–7 relate to lubricants prepared for comparison, and in Comparative Example 1, only granulated sugar was added and the amount thereof was too small and in Comparative Example 2, the amounts of the granulated sugar and the disaccharide caramel were too large. In Comparative Examples 3, 4 and 5, the lubricants contained only sucrose and did not contain the disaccharide caramel, and they contained 10% by mass of granulated sugar, crystal sugar or cane sugar as sucrose, respectively. In Comparative Examples 6 and 7, 1% by mass of caramel prepared from glucose which was a monosaccharide was used in place of the disaccharide caramel.

The frictional wear test was conducted by a thrust type frictional wear tester using a Cu-23% (mass) Pb alloy (sintered material with back plate) as a bearing material and SUS304 as a material of the counter member. The test was carried out by immersing the bearing material in the lubricant. The surface roughness of the test piece was Ry 0.3 μm or less for both the bearing material and the counter member, and the temperature of the lubricant at starting of the test was 30° C. The frictional wear test was carried out for 2 hours under the conditions of 30 m/min in sliding speed and 2 MPa in specific load, and the seizing test was carried out under the conditions that the sliding speed was 30 m/min and the specific load was increased by 0.5 MPa every 10 minutes. The test results are shown in Table 1. As for the judgement on seizing, when the back temperature of the sample rose to 200° C. or higher or when an abrupt increase of torque occurred, the specific load just before seizing was taken as a critical seizing load.

TABLE 1

| | Granulated sugar mass % | Coffee sugar mass % | Crystal sugar mass % | Cane sugar mass % | Disaccharide caramel mass % | Glucose caramel mass % | Sodium laurate mass % | Potassium sorbate mass % | Benzotriazole mass % | Abrasive wear μm | Friction coefficient | Critical seizing load MPa |
|---|---|---|---|---|---|---|---|---|---|---|---|---|
| Example 1 | 0.5 | No | No | No | 0.015 | No | No | No | No | 4.0 | 0.015 | 2.0 |
| Example 2 | 25 | No | No | No | 5 | No | No | No | No | 3.5 | 0.010 | 3.5 |
| Example 3 | 9 | No | No | No | 1 | No | No | No | No | 3.0 | 0.003 | 3.0 |
| Example 4 | 9 | No | No | No | 1 | No | 0.002 | No | No | 3.0 | 0.003 | 5.5 |

TABLE 1-continued

| | Granulated sugar mass % | Coffee sugar mass % | Crystal sugar mass % | Cane sugar mass % | Disaccharide caramel mass % | Glucose caramel mass % | Sodium laurate mass % | Potassium sorbate mass % | Benzotriazole mass % | Abrasive wear μm | Friction coefficient | Critical seizing load MPa |
|---|---|---|---|---|---|---|---|---|---|---|---|---|
| Example 5 | 9 | No | No | No | 1 | No | 0.9 | No | No | 2.5 | 0.003 | 7.5 |
| Example 6 | 9 | No | No | No | 1 | No | 0.2 | No | No | 2.5 | 0.002 | 8.0 |
| Example 7 | 9 | No | No | No | 1 | No | 0.2 | 1 | 1 | 2.5 | 0.002 | 8.0 |
| Example 8 | No | No | 9 | No | 1 | No | 0.2 | 0.5 | 0.5 | 3.0 | 0.002 | 8.0 |
| Example 9 | No | No | No | 9 | 1 | No | No | No | No | 3.5 | 0.006 | 3.0 |
| Example 10 | No | 10 | No | No | No | No | No | No | No | 3.0 | 0.003 | 3.0 |
| Comparative Example 1 | 0.4 | No | No | No | No | No | No | No | No | Seizing | 0.181 | 1.5 |
| Comparative Example 2 | 35 | No | No | No | 8 | No | No | No | No | 5.0 | 0.036 | 2.0 |
| Comparative Example 3 | 10 | No | No | No | No | No | No | No | No | 4.0 | 0.110 | 2.0 |
| Comparative Example 4 | No | No | 10 | No | No | No | No | No | No | 4.0 | 0.126 | 2.0 |
| Comparative Example 5 | No | No | No | 10 | No | No | No | No | No | Seizing | 0.163 | 1.5 |
| Comparative Example 6 | 9 | No | No | No | No | 1 | No | No | No | 5.0 | 0.104 | 2.0 |
| Comparative Example 7 | No | No | 9 | No | No | 1 | No | No | No | 5.0 | 0.108 | 2.0 |

As can be seen from the test results, all of the lubricants of Examples 1–10 which contained a suitable amount of sucrose and disaccharide caramel were conspicuously smaller in friction coefficient than those of Comparative Examples 1 and 3–7 which contained no disaccharide caramel. Furthermore, it is clear that the lubricants of Examples 2–10 were superior also in wear resistance (abrasive wear) and anti-seizure characteristics as compared with those of Comparative Examples 1–7. In Example 1 where the amounts of sucrose and disaccharide caramel were relatively small, there were also obtained wear resistance and anti-seizure characteristics equal to or higher than those of comparative examples.

In this case, in Comparative Example 2 where amounts of the sucrose and the disaccharide caramel were too large, the effect to reduce the friction coefficient was not so high, and wear resistance and anti-seizure characteristics were inferior. As can be seen from the results of Comparative Examples 6 and 7, the effect to reduce the friction coefficient could not be obtained with use of glucose caramel prepared from a monosaccharide, and wear resistance and anti-seizure characteristics were inferior. In Table 1, the term "seizing" for Comparative Examples 1 and 5 means that seizure occurred due to abrupt increase of torque during the wear test and the test was stopped. In Comparative Example 2, abnormal phenomenon did not occur during the test, but brown products considerably deposited on the test piece after completion of the test.

Moreover, the Examples were examined, and it was found that the lubricants of Examples 4–8 containing sodium laurate were superior in anti-seizure characteristics to those containing no sodium laurate. Moreover, there is the tendency that the lubricants of Example 3, 8 and 10 containing granulated sugar, crystal sugar or coffee sugar as the sucrose were generally superior in lubrication characteristics to the lubricant of Example 9 containing cane sugar as the sucrose. It is considered that with increase of purity of sucrose, the better lubrication characteristics are obtained. Furthermore, even when a preservative (potassium sorbate) and a rust inhibitor (benzotriazole) were added as in Example 7, the lubrication characteristics were not adversely affected as compared with Example 6.

As mentioned above, the lubricants of Examples 1–10 which contained a suitable amount of sucrose and disaccharide caramel do not pollute natural environment and are substitutable for conventional lubricants, and can provide markedly excellent lubrication characteristics and, particularly, can sharply reduce friction coefficient. Moreover, by adding sodium laurate, the anti-seizure characteristics can further be improved.

Since the lubricants comprising an aqueous solution containing a suitable amount of sucrose and disaccharide caramel may cause generation and proliferation of bacteria or fungi, which result in hygienic problems or problems in lubrication performance, it is desired to add preservatives to inhibit generation and proliferation of bacteria or fungi. Furthermore, since there is the possibility of causing generation of rust on the counter members (sliding surface) in the case of aqueous lubricants, it is desired to add rust inhibitors to inhibit rusting of the counter members.

Thus, the inventors conducted tests (preservative test and rust inhibition test) to examine suitability of preservatives and rust inhibitors to be used in the lubricants of the present invention. Explanation on details of the tests is omitted here, and the preservative test was conducted by determining preservative effects of four preservatives (sodium benzoate, potassium sorbate, sodium dehydroacetate, and iodine) when these preservatives were added to the lubricants. From the results of the preservative test, it is clear that potassium sorbate is most preferred as preservatives used in the lubricants of the present invention.

Furthermore, it is clarified that the amount of potassium sorbate added is suitably 0.1–3% by mass based on the total amount of the aqueous solution, and if it is less than 0.1% by mass, no sufficient effect as a preservative can be obtained, and even if the preservative is added in an amount of more than 3% by mass, the effect no longer changes. This potassium sorbate is used also for foods, etc. and hardly affects the human bodies and environment.

Next, the rust inhibition test was conducted by determining rust inhibition effects of three rust inhibitors (benzotriazole, sodium nitrite, and ammonium citrate) when these rust inhibitors were added to the lubricants. From the results of the rust inhibition test, it is clear that benzotriazole and alkali metal salts thereof are most preferred as rust inhibitors used in the lubricants of the present invention. Benzotriazole and alkali metal salts thereof can provide similar rust inhibiting effects, but the solubility in the aqueous solution is further improved in the case of the alkali metal salts.

Furthermore, it is also clarified that the amount of benzotriazole and alkali metal salts thereof added is suitably 0.1–3% by mass based on the total amount of the aqueous solution, and if it is less than 0.1% by mass, no sufficient effect as rust inhibitors can be obtained, and even if the rust inhibitors are added in an amount of more than 3% by mass, the effect no longer changes.

The present invention is not limited to the above embodiments, and, for example, the lubricants of the present invention can be applied not only to the bearing units for hydroelectric power generators, but also to various uses such as lubrication of bearing portions, gear portions, piston portions, cylinder portions, etc. of engines and speed regulators of motorcars, electric motors, diesel engines, and various industrial machines, and hydraulic oils. Furthermore, as the alkali metal salts of lauric acid, not only sodium laurate, but also potassium laurate (and mixtures of them) can be used. Moreover, the lubricants of the present invention can be used in such a manner that they are provided in the form of concentrated solutions and diluted with water in actual use. Thus, the present invention can be practiced with optional changes and modification without departing from the spirit and scope of the invention.

What is claimed is:

1. A lubricant which comprises an aqueous solution containing a saccharide in an amount of 0.5–30% by mass based on the total amount of the aqueous solution, said saccharide comprising a sucrose and a disaccharide caramel in an amount of 0.2–20% by mass based on the amount of the sucrose, and sodium laurate and/or potassium laurate in an amount of 0.001–1% by mass based on the total amount of the aqueous solution.

2. A lubricant according to claim 1 which contains benzotriazole or an alkali metal salt thereof in an amount of 0.1–3% by mass based on the total amount of the aqueous solution.

3. A lubricant according to claim 1 which contains potassium sorbate in an amount of 0.1–3% by mass based on the total amount of the aqueous solution.

4. A lubricant according to claim 3 which contains benzotriazole or an alkali metal salt thereof in an amount of 0.1–3% by mass based on the total amount of the aqueous solution.

* * * * *